US008640333B2

(12) United States Patent
Lyford et al.

(10) Patent No.: US 8,640,333 B2
(45) Date of Patent: Feb. 4, 2014

(54) METHOD OF MANUFACTURING AN ELECTRICAL CONTACT ASSEMBLY

(75) Inventors: J. Steven Lyford, Portland, OR (US); Neil Clayton, Hillsboro, OR (US)

(73) Assignee: Tektronix, Inc., Beaverton, OR (US)

( * ) Notice: Subject to any disclaimer, the term of this patent is extended or adjusted under 35 U.S.C. 154(b) by 116 days.

(21) Appl. No.: 13/280,262

(22) Filed: Oct. 24, 2011

(65) Prior Publication Data

US 2012/0036714 A1 Feb. 16, 2012

Related U.S. Application Data

(62) Division of application No. 12/559,610, filed on Sep. 15, 2009, now abandoned.

(60) Provisional application No. 61/109,173, filed on Oct. 28, 2008.

(51) Int. Cl.
*H01R 43/04* (2006.01)

(52) U.S. Cl.
USPC ..... 29/863; 29/566.2; 29/749; 29/753; 29/860; 439/730; 439/882; 439/885

(58) Field of Classification Search
USPC ..... 29/33 M, 564.6, 566.2, 747, 749, 753, 29/755, 857, 860–863; 439/717, 730, 882, 439/885
See application file for complete search history.

(56) References Cited

U.S. PATENT DOCUMENTS

| | | | | |
|---|---|---|---|---|
| 3,146,921 | A | 9/1964 | Brady | |
| 3,163,485 | A | 12/1964 | Kruitwagen | |
| 3,550,856 | A | 12/1970 | Wise | |
| 3,634,817 | A | 1/1972 | Wise | |
| 4,363,167 | A * | 12/1982 | Boutcher et al. | 29/863 |
| 5,564,613 | A * | 10/1996 | Baldyga | 29/566.2 |

* cited by examiner

*Primary Examiner* — Donghai D Nguyen
(74) *Attorney, Agent, or Firm* — William K. Bucher; Marger Johnson & McCollom, PC

(57) ABSTRACT

An electrical contact assembly has a plurality of formed elongate closed seam tubular elements attached to a carrier with each of the elongate tubular elements attached to the carrier via a tab. Scored creases are formed in the tabs for separating the elongate tubular elements from the assembly and scored creases are formed in the carrier for defining carrier strips. The carrier strip had a plurality of grouped elongate tubular elements. The electrical contact assembly is placed in a crimping die where at least one or more wires are inserting into selected elongate tubular elements. Pressure is applied to least one or more of the selected elongate tubular elements to produce bulk material deformation along a substantial portion of the elongate tubular elements to crimp the elongate tubular elements to the wires as electrical contacts.

4 Claims, 8 Drawing Sheets

METHOD OF MANUFACTURING AN ELECTRICAL CONTACT ASSEMBLY

CROSS-REFERENCE TO RELATED APPLICATION

This divisional patent application claims priority from U.S. patent application Ser. No. 12/559,610, filed Sep. 15, 2009 now abandoned, that claims priority from U.S. provisional patent application Ser. No. 61/109,173, filed Oct. 28, 2008.

BACKGROUND OF THE INVENTION

The present invention relates generally to electrical contacts for electrical cables and more particularly to an inexpensive electrical contact assembly and manufacturing method.

Various methods have been used to attach an electrical contact to a wire. One method is to solder the electrical contact to the wire. Other methods include contact resistance welding, laser welding and crimping. Soldering a nichrome wire to an electrical contact requires a highly acidic flux, which compromises the reliability of the solder joint. A crimping process used by Tyco Electronics Ltd/Precision Interconnect, Pembroke, Bermuda, uses a micro-socket ferrule as the electrical contact and a four-point crimping process to crimp the micro-socket ferrule to a wire. The four-point crimping process uses a multi-axis crimping tool that deforms the micro-socket ferrule at four points in a plane perpendicular to the axis of the micro-socket ferrule to capture the wire in the ferrule. The crimping tool may crimp the micro-socket ferrule at additional locations on the ferrule.

A drawback to the four point crimping process is the use of micro-socket ferrules. Each micro-socket ferrule is formed using a screw machine process and then plated. This process results in a high material cost for each ferrule. In addition, each crimped micro-socket ferrule is individually soldered to an electrical contact pad of a circuit board or substrate. The soldering process becomes more difficult when multiple crimped ferrules, such as connected to wires of a ribbon cable, are soldered to adjacent electrical pads on a circuit board.

What is needed is an electrical contact that is easy to manufacture and less expensive than existing electrical contacts using micro-socket ferrules. The electrical contact should lend itself to an easy crimping process and soldering to electrical pads on a circuit board.

SUMMARY OF THE INVENTION

An electrical contact assembly according to the present invention has a unitary sheet of electrically conductive material preferably made of a metallic material, such as copper. The electrical contact assembly has a plurality of formed, laterally spaced and aligned elongate closed seam tubular elements attached to a carrier. A tab attaches each of the elongate closed seam tubular elements to the carrier. The tab may have a scored crease therein for separating the elongate tubular element from the carrier. The unitary sheet of metallic material is preferably plated with tin over sulfamate nickel. The ends of the plurality elongate closed seam tubular elements opposite the tabs are preferably formed with a chamfer.

A carrier strip may be formed in the carrier by grouping a plurality of the formed, laterally spaced and aligned elongate closed seam tubular elements. Scored creases are formed in the carrier parallel with the elongate closed seam tubular elements defining the carrier strip. In the preferred embodiment, the carrier strip has eight of the formed laterally spaced and aligned elongate closed seam tubular elements.

A method of crimping an electrical contact on an electrically conductive wire has an initial step of placing the unitary sheet of electrically conductive material having the plurality of formed, laterally spaced and aligned elongate closed seam tubular elements attached to a carrier via tabs having a scored crease therein into a crimping die. A wire, made of nichrome, copper strands or the like, is inserted into a selected one of the plurality of elongate closed seam tubular elements. Pressure is applied to the unitary sheet of electrically conductive material to produce bulk material deformation on a substantial portion of the selected one of the plurality of the elongate closed seam tubular elements to crimp the elongate closed seam tubular element onto the wire and separate the crimped elongate closed seam tubular element from the carrier at the scored crease in the tab.

The method of crimping electrical contacts on electrically conductive wires may be further implemented by the steps of placing an electrical contact assembly of the unitary sheet of electrically conductive material having the plurality of formed, laterally spaced and aligned elongate closed seam tubular elements attached to a carrier via respective tabs, with a carrier strip defining groupings of the plurality of the elongate closed seam tubular elements by scored creases in the carrier parallel with the elongate closed seam tubular elements, into a crimping die. Wires made of nichrome, copper strands or the like are inserted into each of the plurality of elongate closed seam tubular elements of the electrical contact assembly. Pressure is applied to the electrical contact assembly to produce bulk material deformation on a substantial portion of each of the plurality of formed elongate closed seam tubular elements of the electrical contact assembly to crimp the plurality of elongate closed seam tubular elements onto the plurality of wires as electrical contacts. The electrical contact assembly is preferably separated from the carrier and individually placed in the crimping die. The electrical contacts of the electrical contact assembly are separated from the carrier at the scored creases in the carrier subsequent to the crimping process.

The electrical contact assembly with the plurality of electrical contacts crimped on the wires are placed on electrical contact pads on a circuit board corresponding to the positions of the electrical contacts of the electrical contact assembly. The electrical contacts of the electrical contact assembly are soldered to the electrical contact pads on the circuit board and the carrier strip is separated from each of the electrical contacts at the scored creases in the tabs. The soldering step includes placing a hot bar on the electrical contacts of the electrical contact assembly to solder the electrical contacts to the electrical contact pads on the circuit board.

The objects, advantages and novel features of the present invention are apparent from the following detailed description when read in conjunction with appended claims and attached drawings.

BRIEF DESCRIPTION OF THE DRAWING FIGURES

DESCRIPTION OF THE INVENTION

The electrical contact assembly described below may use specific numerical values to define the dimensions of elements. These numerical values are exemplary and other dimensional values may be used without departing from the scope of the present invention.

Figure 1:
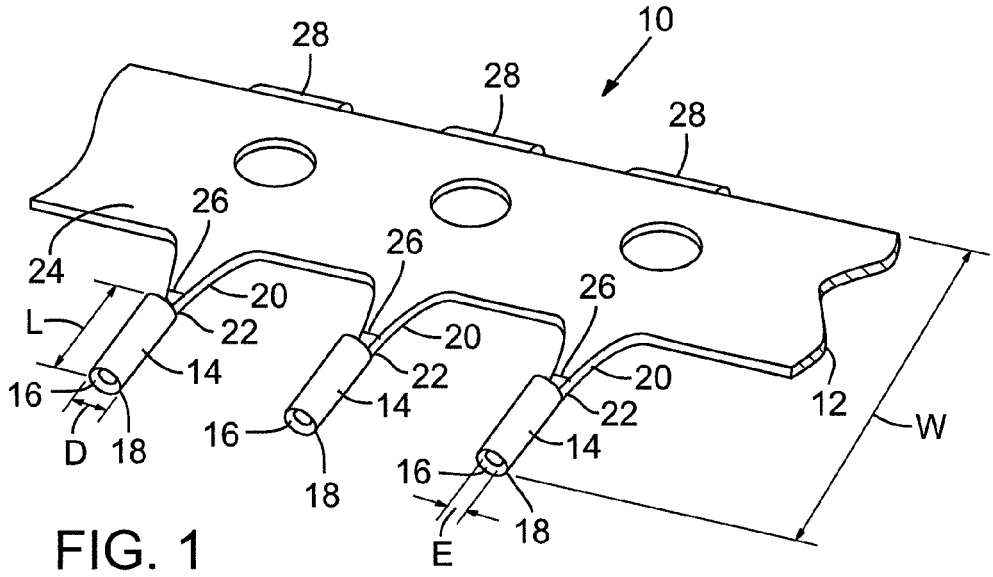
FIG. 1 is a perspective view of an electrical contact assembly according to the present invention.

FIG. 1 illustrates a perspective view of portion of an electrical contact assembly 10 according to the present invention. The electrical contact assembly 10 is formed of a unitary sheet 12 of electrically conductive material. The unitary sheet 12 is preferably a metallic material, such as copper, brass or the like, that is preferably plated with an electrically conductive material, such as tin over sulfamate nickel. The unitary sheet 12 is stamped to form elongate tubular elements 14 having closed seams, a tab 20 and a carrier 24. Each of the elongate closed seam tubular elements 14 has a chamfer 16 at one end 18 and the tab 20 formed at the other end 22. Each tab 20 connects the elongate closed seam tubular elements 14 to the carrier 24. A scored crease 26, perpendicular to the axis of the elongate closed seam tubular elements 14, may be formed in each of the tabs 20 for separating the tubular elements 14 from the carrier 24. Vertical tabs 28 extend down from the back surface of the carrier 24 for aligning the carrier 24 in a crimping die. The stamping of the unitary sheet 12 laterally spaces and aligns the elongate closed seam tubular elements 14 relative to the carrier 24. The elongate closed seam tubular element 14 has a nominal outer diameter "D" of 0.0300 inches and a length "L" of 0.100 inches. The inside diameter "E" of the elongate closed seam tubular element 14 is 0.014 inches. The lateral spacing between centers of the elongate closed seam tubular elements 14 is 0.200 inches. The overall width "W" of the stamped unitary sheet 12 is 0.375 inches.

Figure 2A:
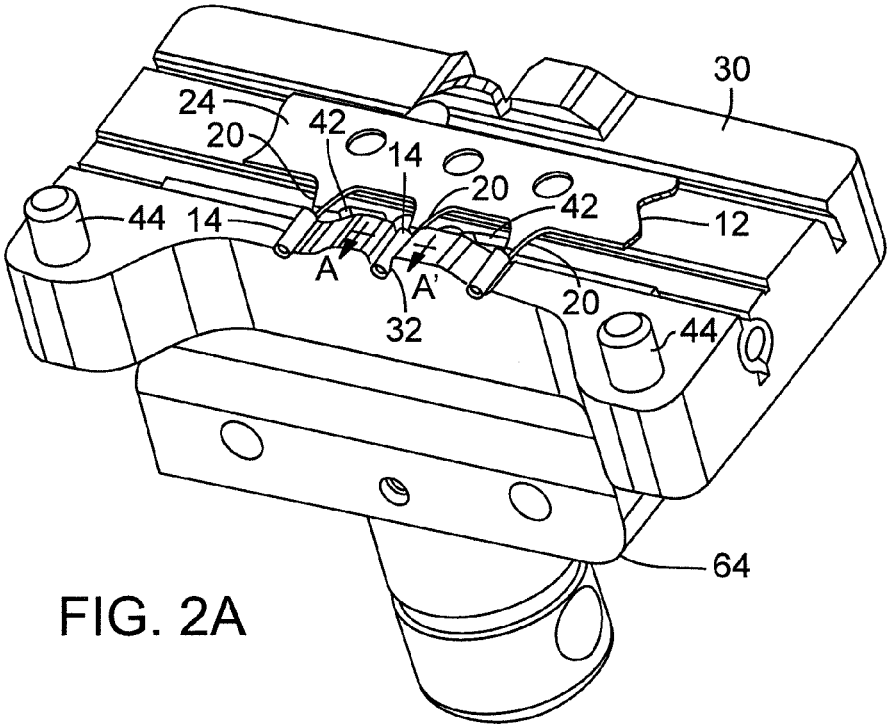
FIG. 2A is a perspective view of the lower crimping die for forming an electrical contact according to the present invention.
Figure 2B:
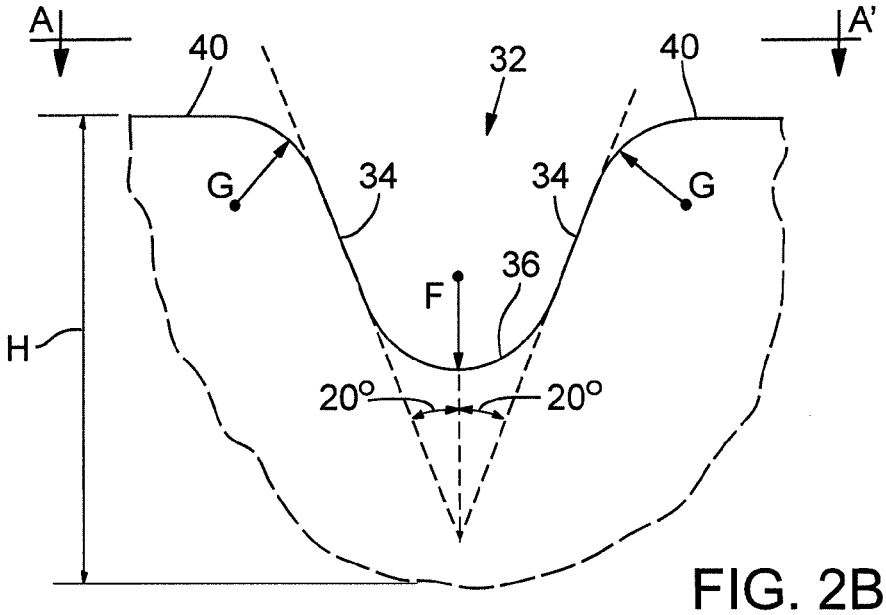
FIG. 2B is a cross-sectional view along A-A' of the valley in the lower crimping die for forming the electrical contact according to the present invention.

FIG. 2A is a perspective view of a lower crimping die 30 for crimping the elongate closed seam tubular elements 14 to wires. The perspective view of FIG. 2A shows a portion of the electrical contact assembly 10 formed as the carrier 24, tabs 20 and elongate closed seam tubular elements 14 placed in the lower crimping die 30. One of the elongate closed seam tubular element 14 is disposed in a valley 32 formed in the die 30. A cross-sectional view of the valley 32 along line A-A', as shown in FIG. 2B, has sides 34 that are preferably outwardly sloped at 20° from vertical with the concave interior surface 36 of the valley 32 having a radius "F" of 0.016 inches and the convex edges 38 of the valley 32 having a radius "G" of 0.015 inches. The height "H" of the valley 32 from the top surface 40 of the lower crimping die 30 to the lowest point in the concave interior surface 36 of the valley is 0.0400 inches. Recesses 42, shown in FIG. 2A, are provided in the crimping die 30 that are located on either side of the tabs 20 of the electrical contact assembly 10. The recesses 42 mate with corresponding tabs in an upper crimping die. Alignment pins 44 are formed in the lower crimping die 30 that mate with corresponding apertures in the upper crimping die.

Figure 3A:
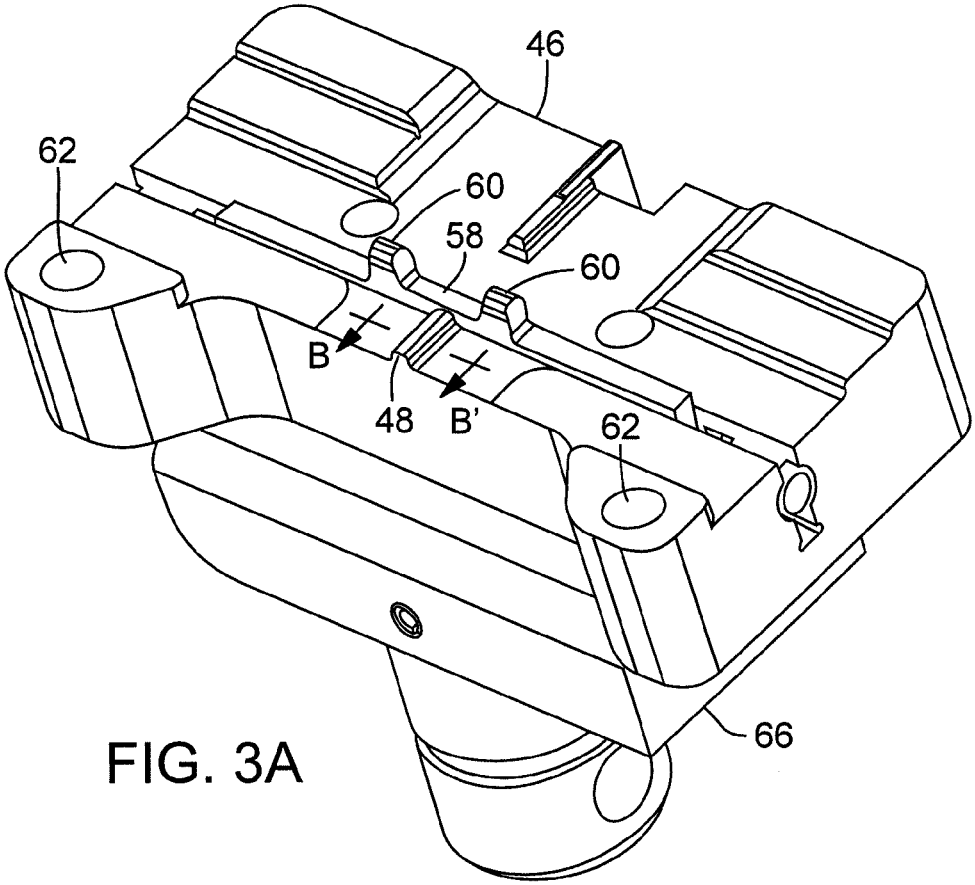
FIG. 3A is a perspective view of the upper crimping die for forming the electrical contact according to the present invention.
Figure 3B:
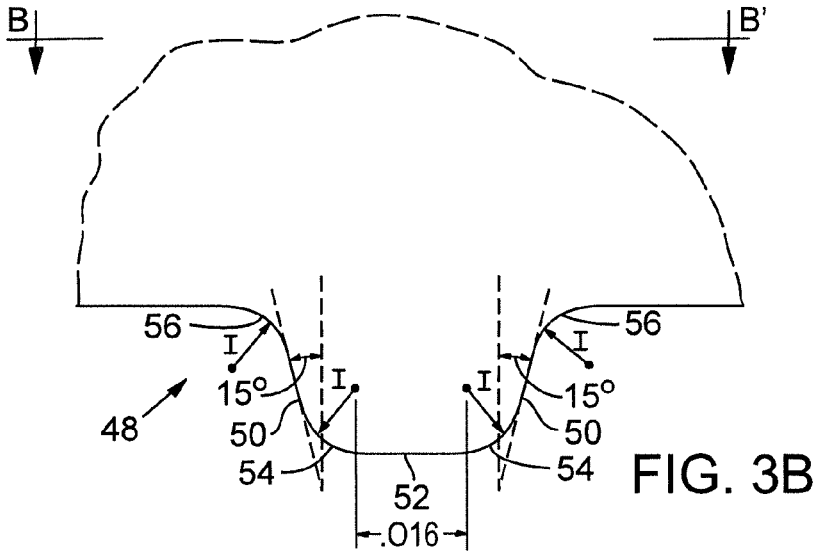
FIG. 3B is a cross-sectional view along B-B' of the tooth in the upper crimping die for forming the electrical contact according to the present invention.

FIG. 3A is a perspective view of the upper crimping die 46 for crimping the elongate closed seam tubular elements 14 onto wires. The upper crimping die 46 has a convex tooth 48 that mates with the valley 32 in the lower crimping die 30 to crimp the elongate closed seam tubular element 14 to a wire. A cross-sectional view of the convex tooth 48 along line B-B', as shown in FIG. 3B, has sides 50 that are preferably outwardly sloped at 15° from vertical. The convex end of the tooth 48 has a flat surface 52 that is 0.016 inches that transition into curved lower and upper edges 54, 56 having radiuses "I" of 0.010 inches. A shear 58 is formed on the upper crimping die 46 that separates downward facing tabs 60 also formed in the crimping die 46. The downward facing tabs 60 mate with the recesses 42 in the lower crimping die 30. Apertures 62 are formed in the upper crimping die that receive the alignments pins 44 in the lower crimping die.

The crimping surfaces of the lower and upper crimping dies 30 and 46 are finished to a grade 16 finish per VDI 3400 guidelines (Verein Deutscher Ingenieure, the Society of German Engineers). The active crimping surface of the upper die 46 is polished to a SPI (Society of Plastic Engineers) No. B-2 finish. The active crimping surface of the lower die 30 is polished to a SPI No. A-2 finish. The polished active crimping surfaces are hard chrome plated to a minimum thickness of 0.0003 inches that result in the final dimensions of the upper and lower die 30 and 46. The above dimensions for the upper crimping die tooth 48 and the lower crimping die valley 32 are nominal values with each of the dimensional values having a plus and minus tolerances. The lower and upper crimping dies 30 and 46 are secured to respective lower and upper die holders 64 and 66, such as manufactured and sold by Astro Tool Corp., Beaverton, Oreg. The lower and upper die holders 64 and 66 may be mounted in a hand press, such as the Model 620175 Cycle Controlled C-frame Style Crimp Tool or the Model 621200 Portable Pneumatic Hex Die Crimper, both manufactured and sold by Astro Tool Corp., Beaverton, Oreg., that provides the compressive force for crimping the elongate closed seam tubular element 14 to a wire.

Figure 4B:
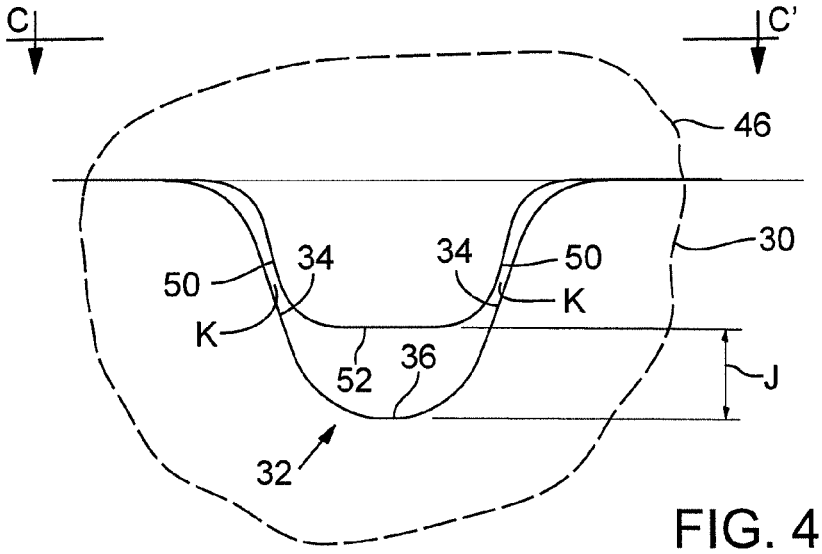
FIG. 4B is a cross-sectional view along C-C' of the closed upper and lower crimping dies for forming the electrical contact according to the present invention.
Figure 4A:
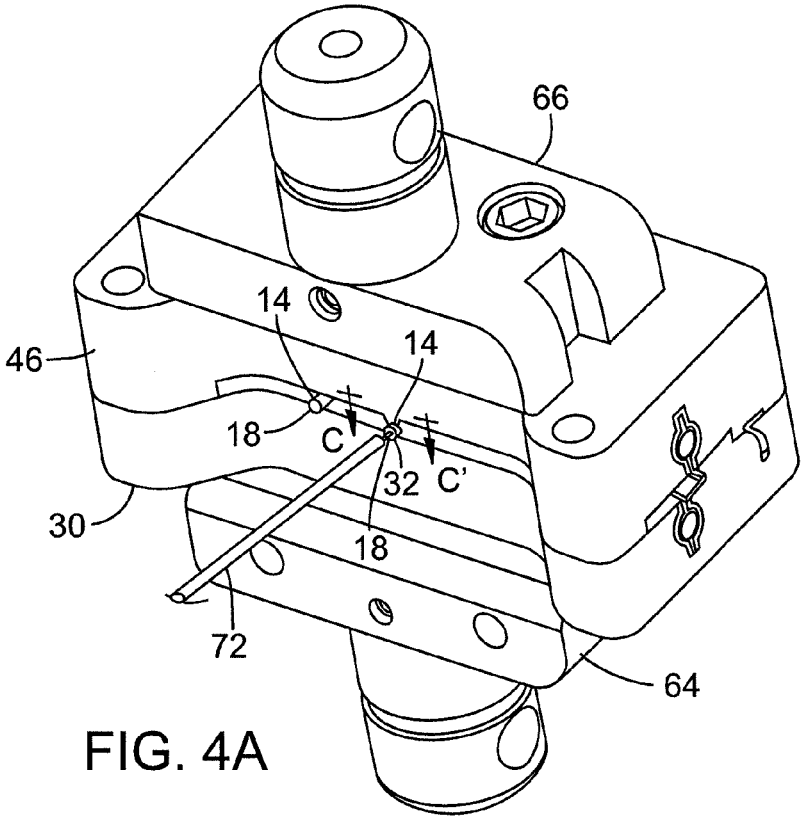
FIG. 4A is a perspective view of the closed upper and lower crimping dies for forming the electrical contact according to the present invention.
Figure 5:
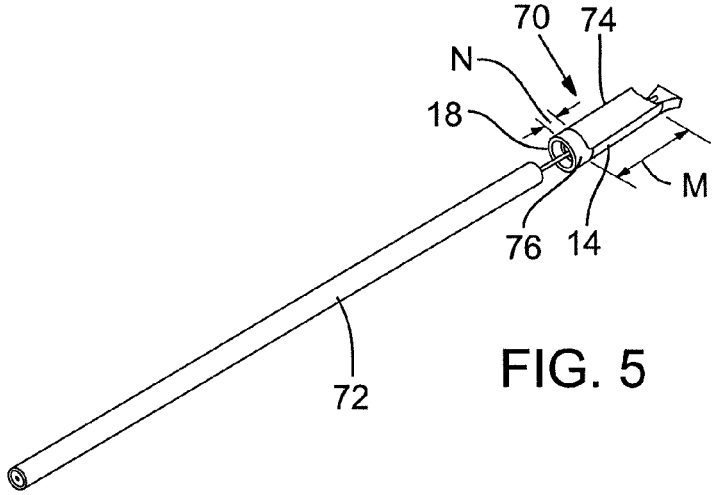
FIG. 5 is a perspective view of the electrical contact crimped onto a wire according to the present invention.

FIGS. 4A, and 5 are perspective views of the upper and lower dies 30 and 46 in a closed position to form an electrical contact 70 in the form of a crimped elongate tubular element 14 on a wire 72. FIG. 4B shows a cross-sectional view along line C-C' of the closed lower and upper crimping dies 30 and 46. The gap "J" between the concave interior surface 36 of the valley 32 and the flat surface 52 of the convex tooth 48 is 0.015 inches and the minimum gap "K" between the sides of the 34 and 50 of the respective valley and convex tooth are 0.0014 inches.

The electrical contact assembly 10 formed as the carrier 24, tabs 20 and elongate closed seam tubular elements 14 is placed in the lower crimping die 30 as shown in FIG. 4A. A wire 72 is inserted via the chamfered end 18 into the elongate closed seam tubular element 14 positioned in the valley 32 in the lower crimping die 30. In the preferred embodiment, the wire 72 is made of 40 AWG nichrome which requires the tubular element 14 to have a closed seam to prevent the 40 AWG solid nichrome wire from escaping the tubular element 14. The convex tooth 48 of the upper crimping die 46 is lowered into the valley 32 of the first crimping die 30. Pressure is applied to the lower and upper crimping die 30 and 46 which produces bulk material deformation 74 of a substantial portion of the elongate closed seam elongate element 14. The bulk material deformation 74 evacuates the empty space within the elongate closed seam tubular element 14 causing the deformed portion 74 of the tubular element 14 to engage the wire 72. The deformed or crimped portion 74 of the elongate closed seam tubular element 14 has a length "M" of 0.085 inches. The chamfered end 18 of the elongate closed seam tubular element 14 is not crimped thus forming a bell mouth 76 having a length "N" of 0.015 inches that provides strain relief for the wire 72. The tabs 60 of the upper crimping die 46 mate with the recesses in the lower crimping die 30 with the shear 58 engaging the scored crease 26 in the tab 20 to separate the crimped elongate closed seam tubular element 14 from the carrier 24.

Figure 6:
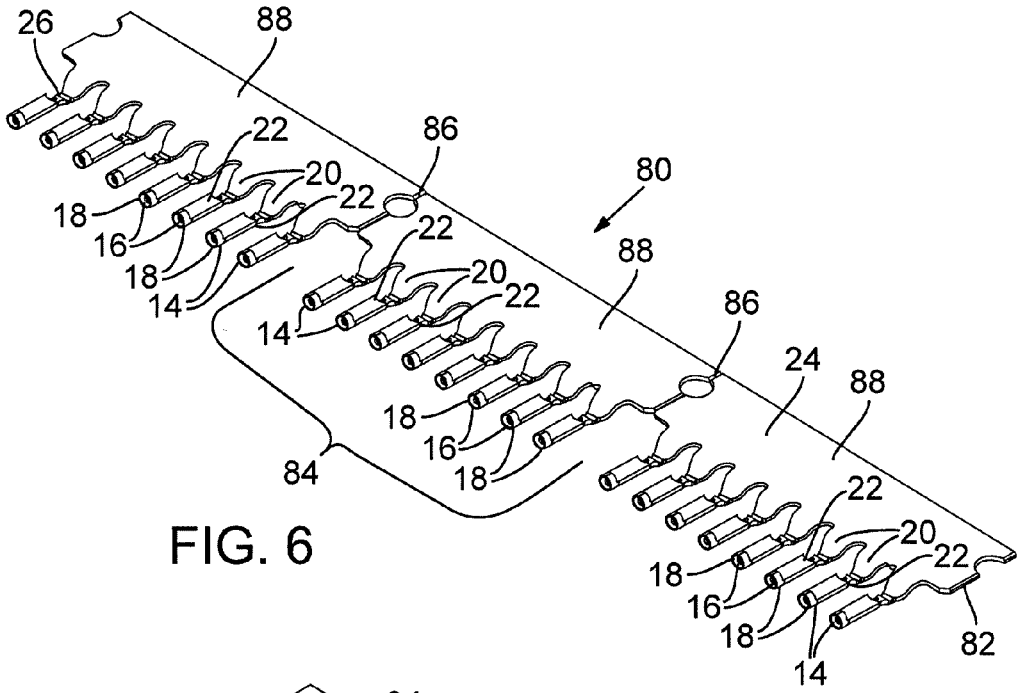
FIG. 6 is a perspective view of an alternative electrical contact assembly according to the present invention.

Referring to FIG. 6, there is illustrated an alternative electrical contact assembly 80 formed from a unitary sheet 82 of electrically conductive material where the elongate closed seam tubular elements 14 are grouped together 84 on the carrier 24. Like elements from the previous drawing figures are labeled the same in this and subsequently described drawing figures. As described for the unitary sheet 12, the unitary sheet 82 is preferably a metallic material, such as copper, brass or the like, that is preferably plated with an electrically conductive material, such as tin over sulfamate nickel. The unitary sheet 82 is stamped to form the groupings 84 of the elongate closed seam tubular elements 14 with the carrier 24 having scored creases 86 parallel with the elongate closed seam tubular elements 14 defining carrier strips 88 for the electrical contact assembly 80. Each of the elongate closed seam tubular elements 14 has the chamfer 16 at one end 18 and the tab 20 formed at the other end 22 for connecting the elongate closed seam tubular elements 14 to the carrier strip 88. The tabs 20 are angled upward such that the carrier strip 88 is at a higher parallel plane than the elongate closed seam tubular elements 14. The upward angling of the tabs 20 allows the carrier strip 88 to be positioned over elements on a substrate, such as a circuit board. The scored creases 26, perpendicular to the axis of the elongate closed seam tubular elements 14, are formed in the tab 20 for separating the groupings 84 of tubular elements 14 from the carrier strip 88. The stamping of the unitary sheet 82 as an electrical contact assembly 80 laterally spaces and aligns the grouped 84 elongate closed seam tubular elements 14 on the carrier strip 88 in three mutually perpendicular planes. The center-to-center lateral spacing between the elongate closed seam tubular elements 14 on the carrier strip 88 is 0.085 inches. The dimensions of the elongate closed seam tubular elements 14 are the same as the previously described electrical contact assembly 10.

Figure 7:
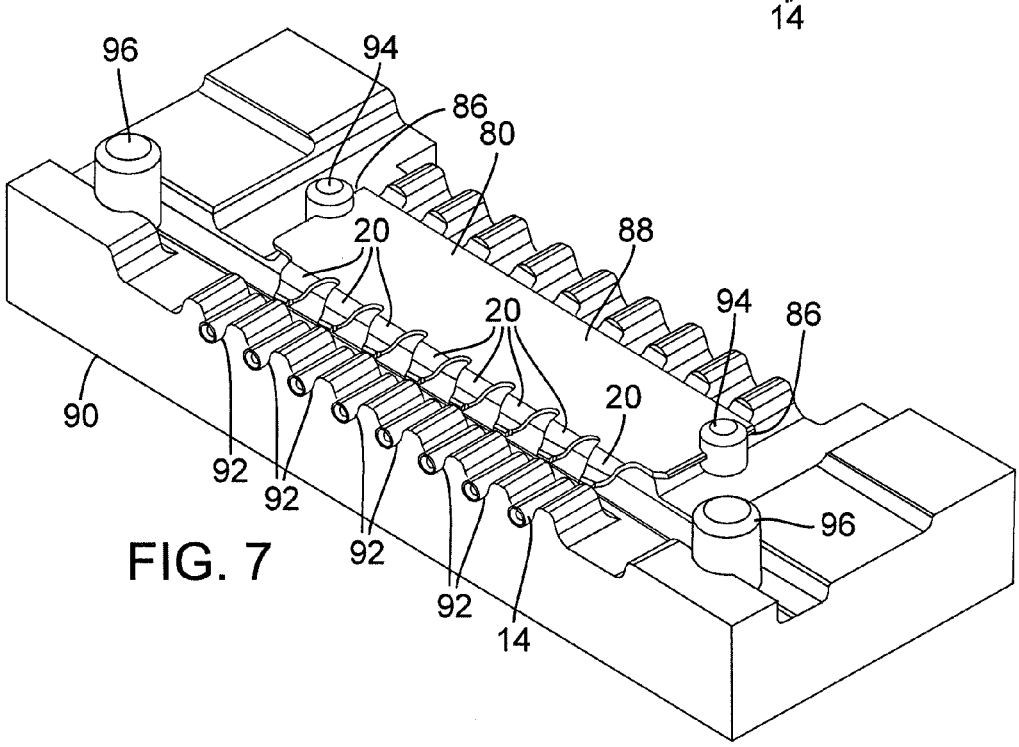
FIG. 7 is a perspective view of the lower crimping die receiving the electrical contact assembly for forming the electrical contacts according to the present invention.

FIG. 7 is a perspective view of the lower crimping die 90 having the electrical contact assembly 80 disposed thereon. The electrical contact assembly 80 having the carrier strip 88 and attached tubular elements 14 is manually separated from the carrier 24 at the scored creases 86. The lower crimping die 90 has multiple concave valleys 92 that match the selected grouping 84 of the elongate closed seam tubular elements 14. In the preferred embodiment, the electrical carrier assembly 80 has a grouping of eight elongate closed seam tubular elements 14 connected to the carrier strip 88 via the tabs 20. The number of elongate closed seam tubular elements 14 in a grouping 84 of tubular elements 14 on the carrier strip 88 is by example only, and other grouping number of tubular elements 14 on the carrier strip 88 is contemplated. The dimensions, plating and finishing of the concave valleys 92 in the lower crimping die 90 are the same as previously described for the concave valleys 32 in the lower crimping die 30. The lower crimping die 90 has a first set of alignment pins 94 for aligning the electrical contact assembly 80 in the lower crimping die 90. A second set of alignment pins 96 are formed in the lower crimping die 90 that mate with corresponding apertures in the upper crimping die.

Figure 8:
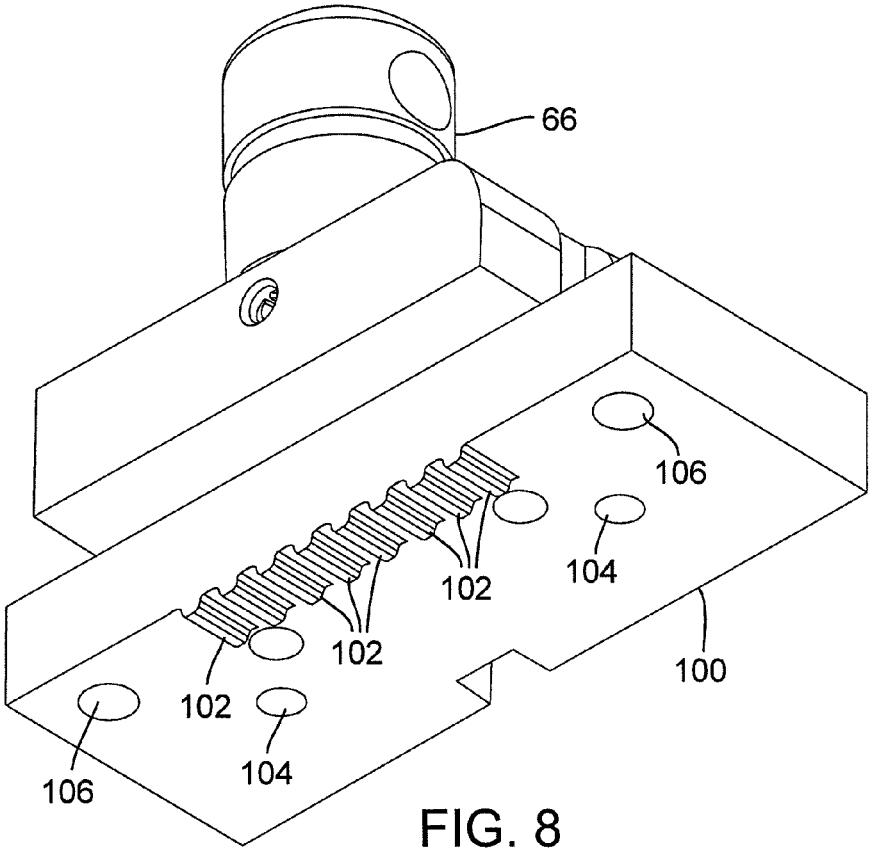
FIG. 8 is a perspective view of the upper crimping die for forming the electrical contact assembly according to the present invention.

FIG. 8 is a perspective view of the upper crimping die 100 for crimping the elongate closed seam tubular elements 14 of the electrical contact assembly 80 onto corresponding wires. The upper crimping die 100 has multiple convex teeth 102 that match the concave valleys 92 in the lower crimping die 90. The dimensions, plating and finishing of the convex teeth 102 in the upper crimping die 100 are the same as previously described for the convex tooth 48 in the upper crimping die 46. A first set of apertures 104 are formed in the upper crimping die 100 for receiving the first set of alignment pins 94 in the lower crimping die 90. A second set of apertures 106 are formed in the upper crimping die 100 for receiving the second set of alignment pins 96 in the lower crimping die 90. As described for the lower and upper crimping dies 30 and 46, the lower and upper crimping dies 90 and 100 are secured to respective lower and upper die holders 64 (not shown) and 66, such as manufactured and sold by Astro Tool Corp., Beaverton, Oreg. The lower and upper die holders 64 and 66 are mounted to a press, such as the Model 621500 Portable Pneumatic Hex Die Crimper, manufactured and sold by Astro Tool Corp., Beaverton, Oreg., that provides the compressive force for crimping the elongate closed seam tubular elements 14 of the electrical contact assembly 80 to respective wires.

Figure 9:
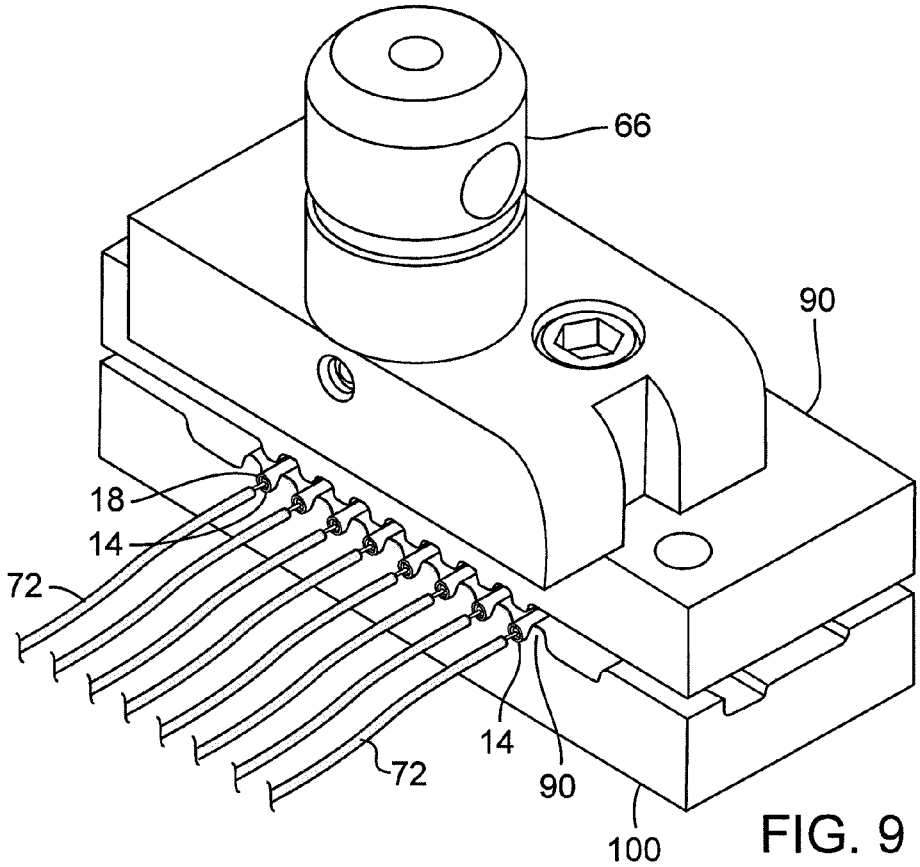
FIG. 9 is a perspective view of the electrical contact assembly disposed between the lower and upper crimping dies for forming the electrical contacts according to the present invention.
Figure 10:
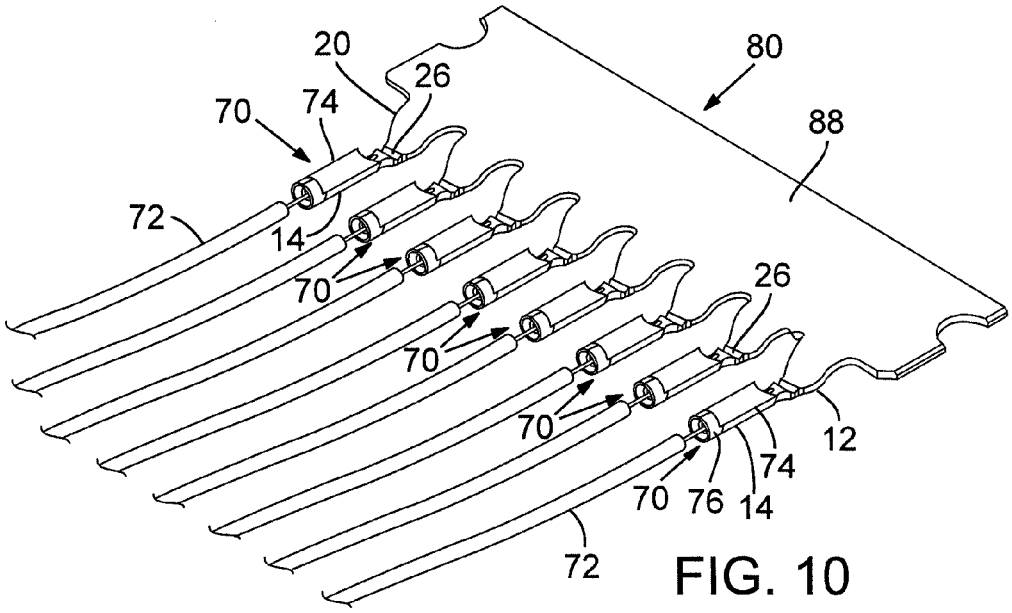
FIG. 10 is a perspective view of the electrical contact assembly having the electrical contacts crimped onto a wire according to the present invention.

FIG. 9 is a perspective view of the lower and upper crimping dies 90 and 100 in a closing position on the elongate closed seam tubular elements 14 to form electrical contacts 70 in the form of crimped elongate tubular elements 14 on wires 72. Wires 72 are inserted via the chamfered ends 18 into each of the elongate closed seam tubular elements 14 positioned in the valleys 92 in the lower crimping die 90. The convex teeth 102 of the upper crimping die 100 are lowered into the valleys 92 of the first crimping die 90. Pressure is applied to the lower and upper crimping dies 90 and 100 which produce bulk material deformation 74 of a substantial portion of the elongate closed seam elongate element 14 as shown in FIG. 10. The bulk material deformation 74 evacuates the empty space within the elongate closed seam tubular element 14 causing the deformed portion 74 of the tubular element 14 to engage the wire 72. The deformed or crimped portion 74 of the elongate closed seam tubular element 14 and the non-deformed bell mouth 76 have the same dimensions as previously described.

Traditional crimping processes deform localized areas of a ferrule or the like using distinct indentations or bending operations. The above crimping process achieves bulk material deformation of the elongate closed seam tubular elements, meaning that all of the material within the crimp is re-shaped. The amount of pressure needed on the crimping dies 90 and 100 to bulk deform the grouping 84 of eight elongate closed seam tubular elements 14 is approximately 4000 lbs.

Figure 11:
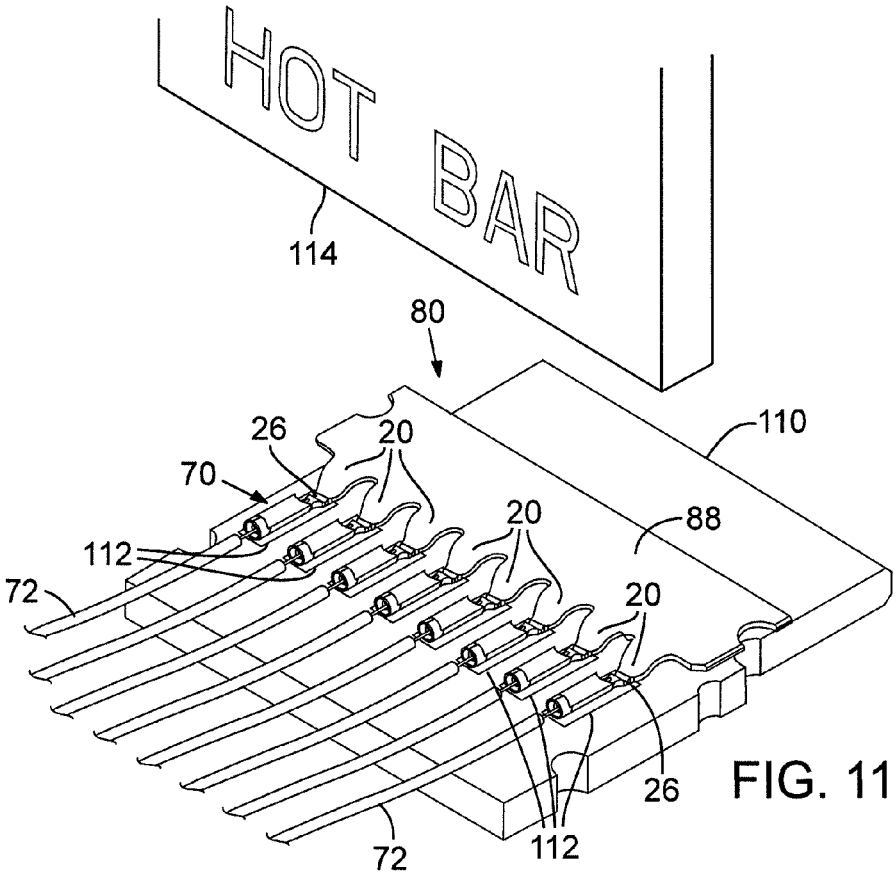
FIG. 11 is a perspective view of the crimped electrical contacts of the electrical contact assembly placed on electrical contact pads of a circuit board.
Figure 12:
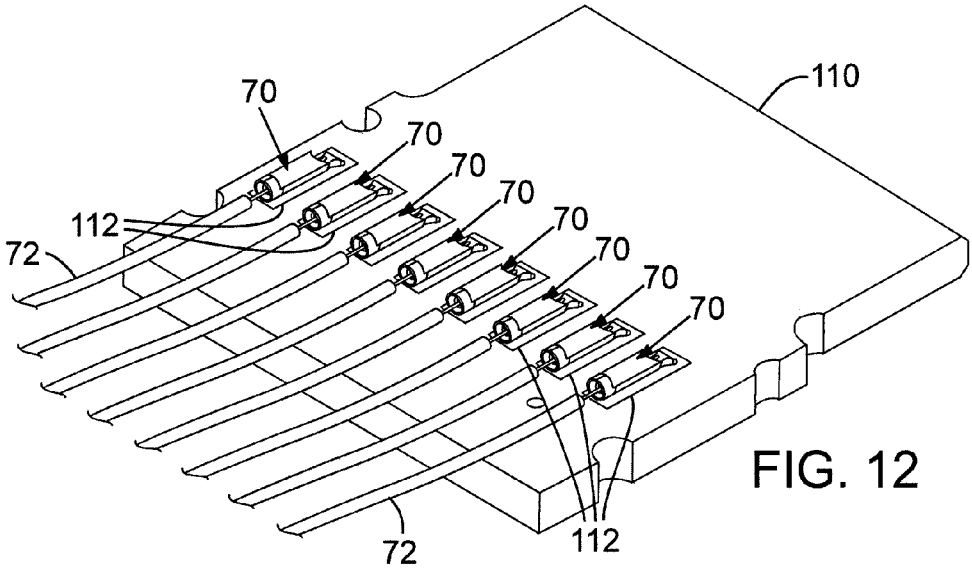
FIG. 12 is a perspective view of the carrier strip separated from the crimped electrical contacts affixed to the electrical contact pads of the circuit board.

FIGS. 11 and 12 are perspective views of the electrical contacts 70 of the electrical contact assembly 80 mounted on circuit board 110 having electrical contact pads 112. The lateral spacing of the electrical contacts 70 and alignment of the electrical contacts 70 in three mutually perpendicular planes provides for easy placement of the electrical contacts 70 on the electrical contact pads 112. In the preferred embodiment, a solder bar 114 is placed on the electrical contacts 70 to solder the electrical contacts 70 to the electrical contact pads 112 at the same time. Once the electrical contacts 70 are soldered to the electrical contact pads 112, the carrier strip 88 is separated from the electrical contacts 70 at the scored creases 26 in the tabs 20.

While the present invention has been described with the elongate closed seam tubular elements 14 crimped onto 40 AWG nichrome wires, it is understood that different gauges of wire can be used. It is contemplated that approximately 32 AWG wire and above is suitable for the electrical contact assembly and manufacture. Further, the grouping of elongate closed seam tubular elements 14 is not restricted to that shown in the drawing figures, and smaller or larger groupings of the elongate closed seam tubular elements 14 are contemplated.

It will be obvious to those having skill in the art that many changes may be made to the details of the above-described embodiments of this invention without departing from the underlying principles thereof. The scope of the present invention should, therefore, be determined only by the following claims.

What is claimed is:

1. A method of crimping electrical contacts on electrically conductive wires comprising the steps of: placing an electrical contact assembly of a unitary sheet of electrically conductive material into a crimping die wherein the electrical contact assembly has a plurality of formed, laterally spaced and aligned elongate closed seam tubular elements attached to a carrier via respective tabs with a carrier strip defining a grouping of the plurality of formed, laterally spaced and aligned elongate closed seam tubular elements by scored creases in the carrier parallel with the elongate closed seam tubular elements; inserting wires into each of the plurality of formed, laterally spaced and aligned elongate closed seam tubular elements in the electrical contact assembly; applying pressure to the electrical contact assembly to produce bulk material deformation on a substantial portion of each of the plurality of formed, laterally spaced and aligned elongate closed seam tubular elements to crimp the plurality of elongate closed seam tubular elements onto the plurality of wires as a plurality of electrical contacts; placing the plurality of electrical contacts of the electrical contact assembly on electrical contacts pads on a substrate corresponding to the positions of the plurality of electrical contacts on the electrical contact assembly; soldering the plurality of electrical contacts of the electrical contact assembly to the electrical contact pads on the substrate; and separating the carrier strip from the plurality of electrical contacts at the scored creases in the tabs.

2. The method of crimping an electrical contact to an electrically conductive wire as recited in claim 1 wherein the inserting step further comprises the step of inserting a plurality of solid nichrome wires into the plurality of formed, laterally spaced and aligned elongate closed seam tubular elements of the electrical contact assembly.

3. The method of crimping an electrical contact to an electrically conductive wire as recited in claim 1 wherein the placing step further comprises the step of manually separating the electrical contact assembly from the carrier prior to placing the electrical contact assembly in the crimping die.

4. The method of crimping an electrical contact to an electrically conductive wire as recited in claim 1 wherein the soldering step further comprises the step of placing a hot bar on the plurality of electrical contacts of the electrical contact assembly to solder the plurality of electrical contacts of the electrical contact assembly to the electrical contact pads on the substrate.

* * * * *